United States Patent [19]

Ishihara et al.

[11] Patent Number: 4,577,675

[45] **Date of Patent: * Mar. 25, 1986**

[54] CERAMIC GUIDE ROLLS FOR USE IN CONTINUOUS CASTING

[75] Inventors: Yoshinobu Ishihara, Osaka; Shinichi Harada, Kobe, both of Japan

[73] Assignee: Kabushiki Kaisha Kobe Seiko Sho, Kobe, Japan

[ * ] Notice: The portion of the term of this patent subsequent to Mar. 25, 2003 has been disclaimed.

[21] Appl. No.: 519,713

[22] Filed: Aug. 2, 1983

[30] Foreign Application Priority Data

Aug. 2, 1982 [JP] Japan ..... 57-118097[U]

[51] Int. Cl.[4] ..... B22D 11/12

[52] U.S. Cl. ..... 164/448; 164/442; 29/124

[58] Field of Search ..... 164/447, 448, 441–443, 164/428, 463, 480; 29/124

[56] References Cited

U.S. PATENT DOCUMENTS 4,416,440 11/1983 Bowman et al. ..... 249/82

*Primary Examiner*—Nicholas P. Godici

*Attorney, Agent, or Firm*—Oblon, Fisher, Spivak, McClelland & Maier

[57] ABSTRACT

A ceramic guide roll having a multitude of discrete ceramic segments cylindrically assembled around the circumference of a steel core shaft of the guide roll, the ceramic guide roll including a stopper member provided at a first end of the steel core shaft and a segment retainer attached to a second end of the steel core shaft opposite the first end through a resilient mechanism for holding the ceramic segments constantly in abutting engagement with each other in the axial direction of the steel core shaft in cooperation with the stopper member.

4 Claims, 2 Drawing Figures

CERAMIC GUIDE ROLLS FOR USE IN CONTINUOUS CASTING

BACKGROUND OF THE INVENTION

1. Field of the Invention

This invention relates generally to guide rolls suitable for guiding hot cast strand in continuous casting, and, more particularly, to a ceramic guide roll construction which can be advantageously used for hot workpieces in continuous casting and other operations.

2. Description of the Prior Art

In continuous steel casting processes, there is an increasing trend toward the energy conservation and simplification of the production line equipment, effectively utilizing the heat of a cast strand in the subsequent hot rolling stage by retaining the heat of the cast strand as it is transferred out of the casing machine after cutting it at a higher temperature. In this instance, the guide rolls which are located before the cutter are required to support a hot cast product of a temperature above 1000° C. as well as a load of a substantial amount.

The conventional guide rolls of this sort are generally constituted by a water-cooled steel shaft of a unitary structure for ensuring the necessary strength, and, in a case where a higher heat resistance is required, such are provided with a surfacing of a heat resistant metal or a ceramic sleeve which is integrally fitted on the steel shaft body. However, the conventional guide rolls of such integral constructions are more or less unsatisfactory in terms of heat resistance, resistance to thermal shocks, resistance to abrasive wear and the strength which is required of the guide rolls to be used for conveying hot cast strand. Consequently, the guide rolls are short in service life and often require replacement, lowering the production efficiency of the casting machine.

With regard to the above-mentioned problems, there has been developed a ceramic guide roll of a composite construction wherein a multitude of discrete ceramic segments are cylindrically assembled around a steel core shaft instead of the conventional integral ceramic sleeve, with a view towards improving the heat resistance properties of the ceramic surfaces and reducing the thermal effects on the steel core shaft by the heat insulating properties of the ceramic material from the standpoint of securing a satisfactory resistance to load of the steel core shaft in addition to advantages in structural strength.

However, a guide roll with a ceramic sleeve consisting of an assembly of discrete segments still has a problem arising from the difference in thermal expansivity between the ceramic sleeve and the steel core shaft. More specifically, except for a guide roll which is divided into a number of sections in the axial direction, the assembled ceramic sleeve is normally greater than the cast steel strip in width, but the temperature of the ceramic sleeve which has a low heat conductivity is elevated to a high level by heat accumulation due to the heat transfer from the cast strip, so that the temperature of the steel core shaft is increased to a considerably high level, for example, to a level of 700° C. at the interface with the ceramic sleeve and to a level of about 400° C. on average.

Under these temperature conditions, since steel has an about 3 to 3.5 times greater thermal expansivity than the ceramic material, the sleeve mounting length which is determined by the segment retainers on the steel core shaft becomes larger than the length of the ceramic sleeve as a result of elongation by thermal expansion of the steel core shaft, the difference in length occurring to a greater degree with a longer core shaft. Consequently, gaps are formed between the ceramic segments, accelerating the heat transmission from the cast strand to the steel core shaft by exposure to the radiant heat of the latter and thus to the thermal fatigue which shortens the service life of the steel core shaft.

SUMMARY OF THE INVENTION

It is therefore a primary object of the present invention to overcome the above-mentioned problem of the assembled ceramic sleeve.

It is a more particular object of the present invention to provide a ceramic guide roll employing a segment retainer spring for resiliently holding the ceramic segments in position on the circumference of a core shaft of the roller in spite of variations occurring in the mounting length of the ceramic sleeve under different temperature conditions.

According to the present invention, there is provided a ceramic guide roll of the type which has a multitude of discrete ceramic segments cylindrically assembled around the circumference of a steel core shaft of the guide roll, the ceramic guide roll essentially comprising a stopper member provided at one end of the steel core shaft and a segment retainer attached to the other end of the steel core shaft through resilient means for continuously holding the ceramic segments in abutting engagement with each other in the axial direction of the steel core shaft in cooperation with the stopper member.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENT

Figure 1:
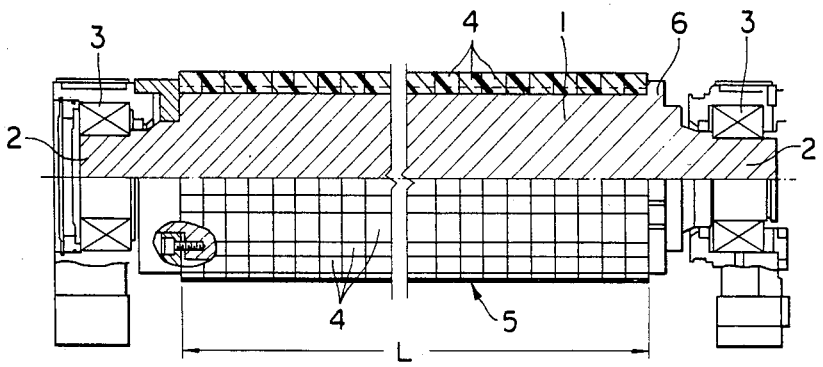
FIG. 1 is a partly cutaway longitudinal sectional view of a ceramic guide roll according to the present invention.
Figure 2:
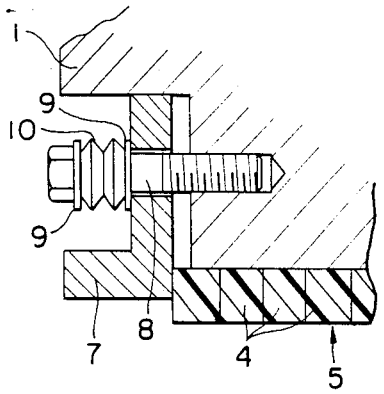
FIG. 2 is a schematic section of a resilient segment retainer provided at one end of a steel core shaft.

Referring to FIGS. 1 and 2 which illustrate one preferred embodiment of the ceramic guide roll according to the present invention, a steel core shaft 1 of the guide roll is rotatably supported by bearings 3 at the journal portions 2 at the opposite ends of the core shaft 1. Provided around the circumference of the core steel shaft 1 is a cylindrical ceramic sleeve 5 substantially coextensive with the steel core shaft 1 and consisting of a multitude of discrete ceramic segments 4 which are assembled into a number of unitary rings in abutting engagement with each other in the axial direction of the core shaft 1. There are no restrictions in particular with regard to the manner of assembling the ceramic segments 4 or the manner of mounting the unitary rings of the assembled ceramic segments 4 on the steel core shaft 1, and thus the illustrations in this regard are omitted from the drawing.

At one end of the core steel shaft 1, the ceramic sleeve 5 is restricted from movement in the axial direction by a stopper flange 6 which is formed around the circumference of the core steel shaft 1, and, at the other end of the core shaft 1, by a segment retainer 7 which is attached to the steel core shaft 1 by a number of bolts 8 located in spaced positions in the circumferential direction of the core shaft 1, thus holding the ceramic segments 4 between the stopper flange 6 and the segment retainer 7 which define a sleeve mounting length L.

According to the present invention, a resilient means is inserted between the segment retainer 7 and the head portion of each retainer mounting bolt 8. In the particular embodiment shown in FIG. 2, coned disc springs 10 are interposed between the bolt heads and the segment retainer through washers 9. The amount of flexure of the disc springs 10 is designed to exceed the total width of the gaps which would be formed between the ceramic segments by thermal expansion as mentioned hereinbefore, thereby holding the unitary rings of the ceramic segments 4 in a constantly abutted state in the axial direction irrespective of variations in temperature conditions to prevent formation of gaps between the individual ceramic segments.

With the above-described roll construction according to the present invention, is no longer necessary to select a quality material in the fabrication of the steel core shafts to cope with the problem of heat transfer to the steel core shaft through the gaps between the ceramic segments. Besides, the respective ceramic segments or segment rings are securely held in position on the circumference of the steel core shaft by the resilient force of the springs and prevented from dislocation or separation from the steel core shaft. Thus, the ceramic guide roll of the present invention can greatly contribute to stabilization and improve the efficiency of various operations which involve transfer of hot strand.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A ceramic guide roll having a steel core and a cylindrical ceramic sleeve positioned around the circumference of the steel core shaft, said cylindrical ceramic sleeve consisting of an assembly of a plurality of discrete ceramic segments, said guide roll comprising:

a stopper member provided at a first end of said steel core shaft; and a segment retainer attached to a second end of said steel core shaft opposite said first end; and resilient means for holding said ceramic segments constantly in abutting engagement with each other in the axial direction of said steel core shaft in cooperation with said stopper member.

2. The ceramic guide roll as set forth in claim 1, wherein said stopper member further comprises a flange member positioned at and around said first end of said steel core shaft.

3. The ceramic guide roll as set forth in claim 1, further comprising a plurality of bolts for attaching said segment retainer to said second end of the steel core shaft, and wherein said resilient member is interposed between a head portion of each bolt and said segment retainer.

4. The ceramic guide roll as set forth in claim 3, wherein said resilient member further comprises a plurality of coned disc springs fitted on said bolts between each respective bolt head of said plurality of bolts and said segment retainer.

* * * * *